US009890501B2

(12) United States Patent
Alias et al.

(10) Patent No.: US 9,890,501 B2
(45) Date of Patent: Feb. 13, 2018

(54) DRYER FABRIC

(71) Applicant: VOITH PATENT GMBH, Heidenheim (DE)

(72) Inventors: Anas Alias, Ipoh (MY); Juergen Abraham, Nattheim (DE)

(73) Assignee: Voith Patent GmbH, Heidenheim (DE)

( * ) Notice: Subject to any disclaimer, the term of this patent is extended or adjusted under 35 U.S.C. 154(b) by 248 days.

(21) Appl. No.: 14/417,561

(22) PCT Filed: Jul. 25, 2013

(86) PCT No.: PCT/EP2013/065672

§ 371 (c)(1),
(2) Date: Jan. 27, 2015

(87) PCT Pub. No.: WO2014/016364

PCT Pub. Date: Jan. 30, 2014

(65) Prior Publication Data

US 2015/0211179 A1 Jul. 30, 2015

(30) Foreign Application Priority Data

Jul. 27, 2012 (FI) ..... 20125819

(51) Int. Cl.
*D21F 7/12* (2006.01)
*D21F 1/00* (2006.01)

(52) U.S. Cl.
CPC ..... *D21F 7/12* (2013.01); *D21F 1/0027* (2013.01); *D21F 1/0054* (2013.01)

(58) Field of Classification Search
CPC ..... D21F 1/10; D21F 1/105; D21F 1/0027; D21F 1/0036; D21F 1/0045;
(Continued)

(56) References Cited

U.S. PATENT DOCUMENTS 2,269,869 A * 1/1942 Specht ..... D21F 1/10 139/425 A
4,395,308 A * 7/1983 Dawes ..... D21F 1/0072 139/383 A
(Continued)

FOREIGN PATENT DOCUMENTS

DE 19923088 C1 10/2000
EP 0837179 A2 4/1998
EP 1736595 A1 12/2006

*Primary Examiner* — Eric Hug
(74) *Attorney, Agent, or Firm* — Laurence A. Greenberg; Werner H. Stemer; Ralph E. Locher

(57) ABSTRACT

A papermaking dryer fabric has a system of MD yarns interwoven with a system of CMD yarns in a single layer weave. The MD yarns have groups each formed of a plurality of adjacent MD yarns weaving in the group side-by-side the same weave path with the CMD yarns. The dryer fabric is flat woven with seaming loops at the widthwise edges of the fabric to make it endless. At least some of the seaming loops are formed by at least some MD yarns of the groups of MD yarns. The MD yarns forming the groups of MD yarns have a circular cross section and the CMD yarns are ungrouped CMD yarns and at least some of said CMD yarns have a non-circular cross section with a width to height ratio of more than 1. The dryer fabric has an air permeability between 25 cfm and 200 cfm.

19 Claims, 4 Drawing Sheets

(58) Field of Classification Search
CPC ..... D21F 1/0054; D21F 7/08; D21F 7/083; D21F 7/10; D21F 7/12; D03D 3/04; D03D 11/00; D03D 13/00
USPC ..... 162/348, 296, 900, 902, 903, 904; 139/383 A, 425 A, 383 AA; 428/397–399, 369–371; 442/192, 193, 442/195, 196
See application file for complete search history.

(56) References Cited

U.S. PATENT DOCUMENTS 4,489,125 A * 12/1984 Gagnon ..... B32B 5/08 139/383 A
4,636,426 A * 1/1987 Fleischer ..... D21F 1/0027 139/383 A
4,829,681 A * 5/1989 Josef ..... D21F 1/0027 139/383 A
5,089,324 A * 2/1992 Jackson ..... D21F 1/0027 139/383 A
5,456,293 A 10/1995 Ostermayer et al.
5,456,764 A 10/1995 Asano et al.
5,464,685 A * 11/1995 Fry ..... D06C 7/02 139/383 A
5,465,764 A * 11/1995 Eschmann ..... D21F 1/0027 139/383 A
5,713,398 A 2/1998 Josef
5,799,708 A * 9/1998 Josef ..... D21F 1/0027 139/383 A
6,319,606 B1 * 11/2001 Best ..... D01D 5/253 428/364
6,332,480 B1 * 12/2001 Best ..... D21F 1/0027 139/383 AA
7,740,029 B2 6/2010 Hodson et al.

* cited by examiner

DRYER FABRIC

BACKGROUND OF THE INVENTION

Field of the Invention

The present invention relates to a papermaking dryer fabric for use in a dryer section of a papermaking machine.

Modern dryer fabrics especially for use in high speed papermaking machines with production speeds of 1200 meters per minute or more need to have relatively low air permeability, low inner void volume and low caliper for low air carriage. The weaving structure of such dryer fabrics has to have as less as possible intersections for low affinity of contamination. Further on such dryer fabrics must guaranty sufficient bending stiffness in the cross-machine direction (CMD) of the fabric.

In the state of the art several attempts for dryer fabrics are known. EP1736595 discloses e.g. a dryer fabric with weft yarns grouped in pairs and with ungrouped warp yarns as well as with weft and warp yarns grouped in pairs. Such fabrics have improved performance due to less water and air carriage, but have the disadvantage that the weaving process of such fabrics is difficult to control because of the parallel insertion of weft yarns which sometimes tend to overly each other instead of weaving parallel to each other.

U.S. Pat. No. 5,799,708 discloses a papermaking fabric with flat shaped warp yarns which are grouped in pairs and with round shaped weft yarns which are ungrouped. Such fabrics have the disadvantage that the forming of seaming loops is difficult, because of the rectangular shape of the warp yarns which tend to twist during the formation of the seam loops. During the joining process of such fabrics in the papermaking machine the twisted seaming loops are difficult to interdigitate and to put a pintle through them.

BRIEF SUMMARY OF THE INVENTION

What is needed is a new dryer fabric design with low water and air carriage, which is easy and controllable to manufacture and easy to join during installation in the papermaking machine.

The problem is solved with a papermaking dryer fabric comprising a system of MD yarns interwoven with a system of CMD yarns in a single layer weave, said fabric comprising groups of MD yarns, wherein each group being formed by a plurality of adjacent MD yarns having a circular cross section and weaving in said group, like a single yarn, side-by-side the same weave path with said CMD yarns. The dryer fabric according to the invention further has only ungrouped CMD yarns which have a non-circular cross section with a width to height ratio of more than 1. The dryer fabric according to the invention further has a air permeability between 25 and 200 cfm.

The CMD yarns are ungrouped or in other words, adjacent CMD yarns weave different weave paths with the MD yarns. Therefore the weaving process is controllable in a reliable manner. Due to use of flat CMD yarns or in other words, CMD yarns with a width to height ratio of more than one, a low calliper fabric can be achieved combined with a reduced number of CMD/MD yarn intersections to provide a fabric with a reduced contamination affinity. Further on the flat CMD yarns give the ability to control or reduce the air permeability of the fabric in a certain range based on the specific choice of the width of the CMD yarns. For a controllable weaving process the maximum width of the CMD yarns is limited 3-4 mm. To further control or reduce the air permeability of the fabric, the invention proposes grouped MD yarns which have a circular cross section, to guaranty untwisted seaming loops and to make joining more easy.

Preferred embodiments of the present invention are further described in the sub-claims.

According to a preferred embodiment of the invention the single layer weave is a plain weave. A plain weave provides a homogenous weaving structure with low making issues to the paper web that comes into contact with the paper-side of the dryer fabric. A plain weave pattern further gives a highly stable fabric with a high rigidity.

To further influence the air permeability of the dryer fabric preferably all CMD yarns of the fabric have a non-circular cross section with a width to height ratio of more than 1.

Preferably all MD yarns form said groups of MD yarns. This further increases the ability to reduce the air permeability to the lower edge of the claimed range and can e.g. lead to air permeability values of 150 cfm or lower.

To achieve that the grouped MD yarns lie in parallel next to each other without overlapping each other, preferably each of the groups of MD yarns is formed by four or less adjacent MD yarns, preferably by two or three MD yarns weaving side-by-side the same weave path with said CMD yarns.

The non-circular CMD yarns for example can have a bone-like cross section (remark: in some prior art documents also called bi-nodal cross section). It is further possible that the non-circular CMD yarns have a rectangular cross section. Further on it is possible that the non-circular CMD yarns have a double convex shaped cross section, wherein double convex shaped means that the cross section consists of two convex halves which cross each other at an angle of more than 0° and less than 180°. The width to height ratio can be 1.5 or more. Preferably the width to height ratio is not more than 2.0 to 4.0.

One of the advantages of ungrouped CMD yarns with non-circular cross section compared to grouped CMD yarns with circular cross section is, that the air permeability can be further reduced without increasing the thickness of the yarns and therefore the thickness of the fabric. Another advantage is that one flat CMD yarn has a smooth surface whereas grouped CMD yarns always generate some gap between them which can serve as traps for contamination.

Especially for high speed applications it is advantageous if the dryer fabric has a high CMD stiffness. To achieve a high CMD stiffness the inventors found out, that the height of the CMD yarns with non-circular cross section preferably should not be below 0.5 mm. To make a sufficiently thin dryer fabric with reduced water and air carriage it is further advantageous is the fabric has a thickness of not more than 1.1 mm. According to a preferred embodiment of the invention it is foreseen, that the thickness of the CMD yarns preferably is between 0.5 mm and 1.1 mm, more preferably between 0.6 mm and 1.0 mm, most preferably between 0.7 mm and 0.9 mm.

To achieve a good balance between low fabric calliper and easy bending of the MD yarns to form the seam loops on the one hand and sufficient stability of the MD yarns to withstand the drive load the fabric is subjected to, the inventors found out that for the dryer fabric design of the present invention it is advantageous, if the MD yarns have a diameter between 0.5 mm and 0.8 mm, preferably between 0.55 mm and 0.65 mm.

To further reduce water and air carriage it is advantageous if the air permeability of the fabric is between 50 cfm and 200 cfm, preferably between 50 cfm and 150 cfm.

Table 1 shows a comparison of the properties between a dryer fabric known from EP1736595 (conventional fabric) and a preferred embodiment of a dryer fabric according to the present invention, were all design features except the one expressively indicated as being different are identical.

TABLE 1

| Weave design: plain weave<br>Paired MD yarns: PET/diameter 0.6 mm/160 to 190 MD yarns per 100 mm<br>CMD yarns: i) conventional fabric PET/diameter 0.8 mm/paired<br>ii) invention fabric PET/height 0.6 mm/width 1.4 mm/ungrouped | | |
|---|---|---|
| Rem:<br>conventional fabric number of CMD yarn pairs<br>invention fabric number of CMD yarns | Air permeability [cfm] (conventional dryer fabric) | Air permeability [cfm] (invention) |
| 73 CMD yarns per 100 mm | 150 | 75 |
| 70 CMD yarns per 100 mm | 180 | 100 |
| 65 CMD yarns per 100 mm | 240 | 140 |

The above disclosed embodiment of the fabric design according to the invention gives the possibility to reduce the air permeability by at least 40%.

The papermaking dryer fabric according to the present invention can have at least some CMD yarns which comprise a two-phase polymeric material, with a first polymeric material that melts at a first temperature and a second polymeric material which is substantially immiscible with the first polymeric material and which melts at a second temperature which is lower than the first temperature, wherein the fabric has been subjected to a heat setting treatment at a temperature at or above the second temperature and below the first temperature. Dryer fabrics according to this embodiment can have a smoother paper contacting surface due to the fact that during heat setting crimp, which is in the MD or warp yarns after the weaving process can be more easily transferred to the CMD or weft yarns. This is especially the case, when the MD yarns are made from a material with a melting temperature above the heat setting temperature.

The second material can include alone or in combination: polyolefins, polyamides or fluoropolymers. The first material can include alone or in combination: homopolymers or copolymers of polyesters e.g. PET, polyamides or PPS.

According to a second aspect of the present invention a method for producing packaging, board or cardboard is provided with the following feature:

Providing a fibrous slurry to at least one forming fabric in a forming section and dewater the slurry through the at least one fabric to form a fibrous web transferring the fibrous web to a at least one pressfelt in a pressing section and dewater the web through at least one press felt transferring the web to a dryer fabric according to one of the claims 1-14 in a dryer section and drying the web when the web is sandwiched between the dryer fabric and a heated dryer cylinder of the dryer section.

Providing a fibrous slurry to at least one forming fabric in a forming section and dewater the slurry through the at least one fabric to form a fibrous web transferring the fibrous web to a at least one pressfelt in a pressing section and dewater the web through at least one press felt transferring the web to a dryer fabric according to the claimed invention in a dryer section and drying the web when the web is sandwiched between the dryer fabric and a heated dryer cylinder of the dryer section.

Due to the fact that the dryer fabric according to the claimed invention has a low internal void volume combined with a smooth surface with reduced number of yarn intersections the dryer fabric is very easy to clean and has an excellent stay clean performance and therefore preferably is usable in the production of packaging, board or cardboard due to the fact that the fibrous slurry for the production of packaging, board or cardboard web often has a high recycled content.

Preferably the dryer fabric according to the claimed invention is used in at least one of the first, second or third dryer group of the dryer section.

The invention will be further illustrated with the following figures, wherein

DESCRIPTION OF THE INVENTION

Figure 1:
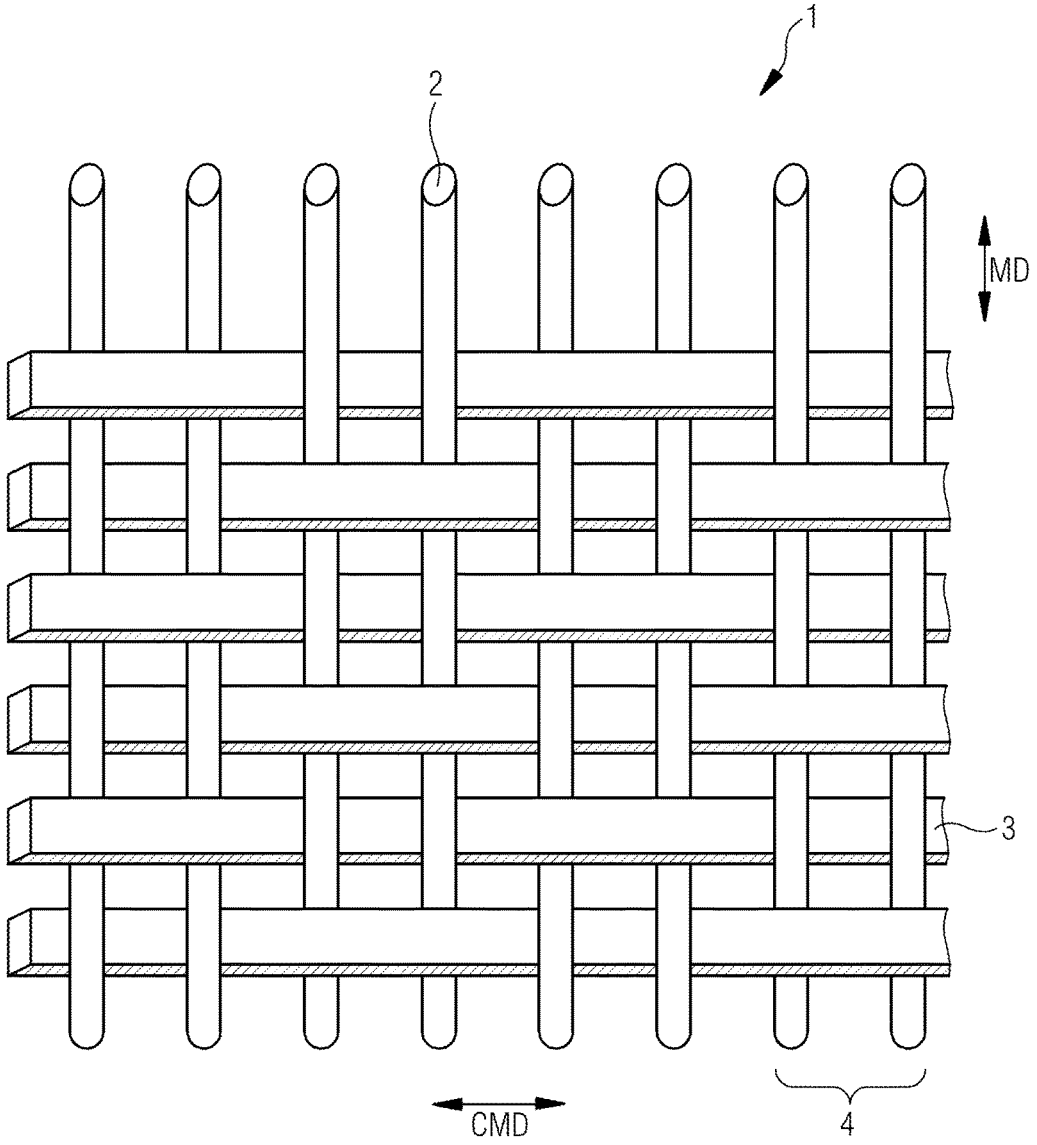
FIG. 1 shows a top view onto a part of the dryer fabric according to the invention.

FIG. 1 shows a top view onto a part of the dryer fabric 1 according to the invention. The fabric 1 has a system of MD yarns 2 interwoven with a system of CMD yarns 3 in a single layer weave. In the embodiment shown in the FIGS. 1-3 the system of MD yarns only consists of groups 4 of two adjacent MD yarns 3 which weave in each group 4 side-by-side the same weave path with the CMD yarns 3. The dryer fabric 1 is flat woven in a plain weave design.

Figure 2:
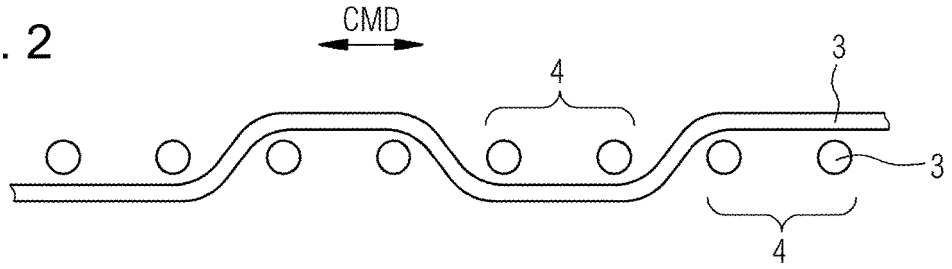
FIG. 2 shows a cross sectional view in CMD direction of the fabric of FIG. 1.
Figure 3:
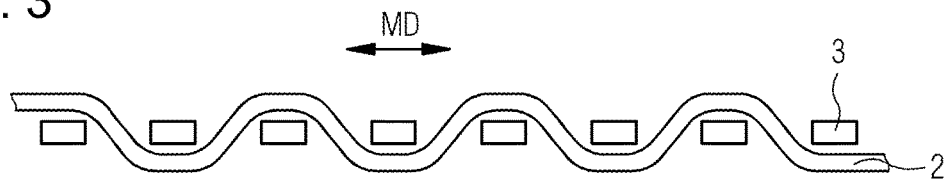
FIG. 3 shows a cross sectional view in MD direction of the fabric of FIG. 1 with CMD yarns having a rectangular cross section.

As can be seen from FIGS. 1 and 2 the MD yarns 2 have a circular cross section. As can be seen from FIGS. 1 and 3 all the CMD yarns 3 are ungrouped—that means adjacent CMD yarns weave different weave paths with the MD yarns 2—and have a rectangular cross section with a width to height ratio of 2. The CMD yarns 3 in the embodiment as shown in FIGS. 1-3 have a height of 0.6 mm, wherein the MD yarns 2 have a diameter of 0.6 mm. The dryer fabric shown can have a air permeability between 75 cfm and 140 cfm.

Figure 4:
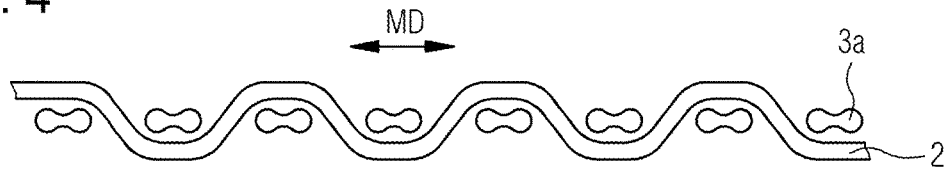
FIG. 4 shows a cross sectional view in MD direction of an alternative fabric with CMD yarns having a bone-like cross section.

FIG. 4 shows a cross sectional view in MD direction of an alternative fabric with CMD yarns 3*a* having a bone-like cross section. The rest of the fabric of FIG. 4 is identical to fabric shown in FIGS. 1 and 2.

Figure 5:
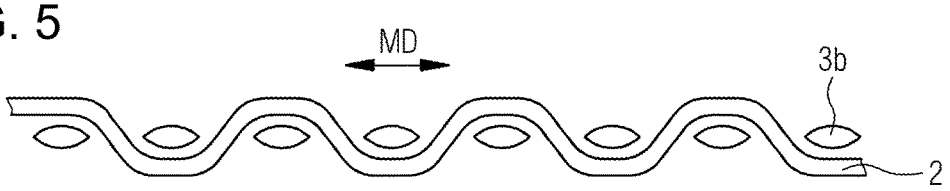
FIG. 5 shows a cross sectional view in MD direction of an alternative fabric with CMD yarns having a double convex shaped cross section.

FIG. 5 shows a cross sectional view in MD direction of an alternative fabric with CMD yarns 3*b* having a double convex shaped cross section. The rest of the fabric of FIG. 5 is identical to fabric shown in FIGS. 1 and 2.

Figure 6:
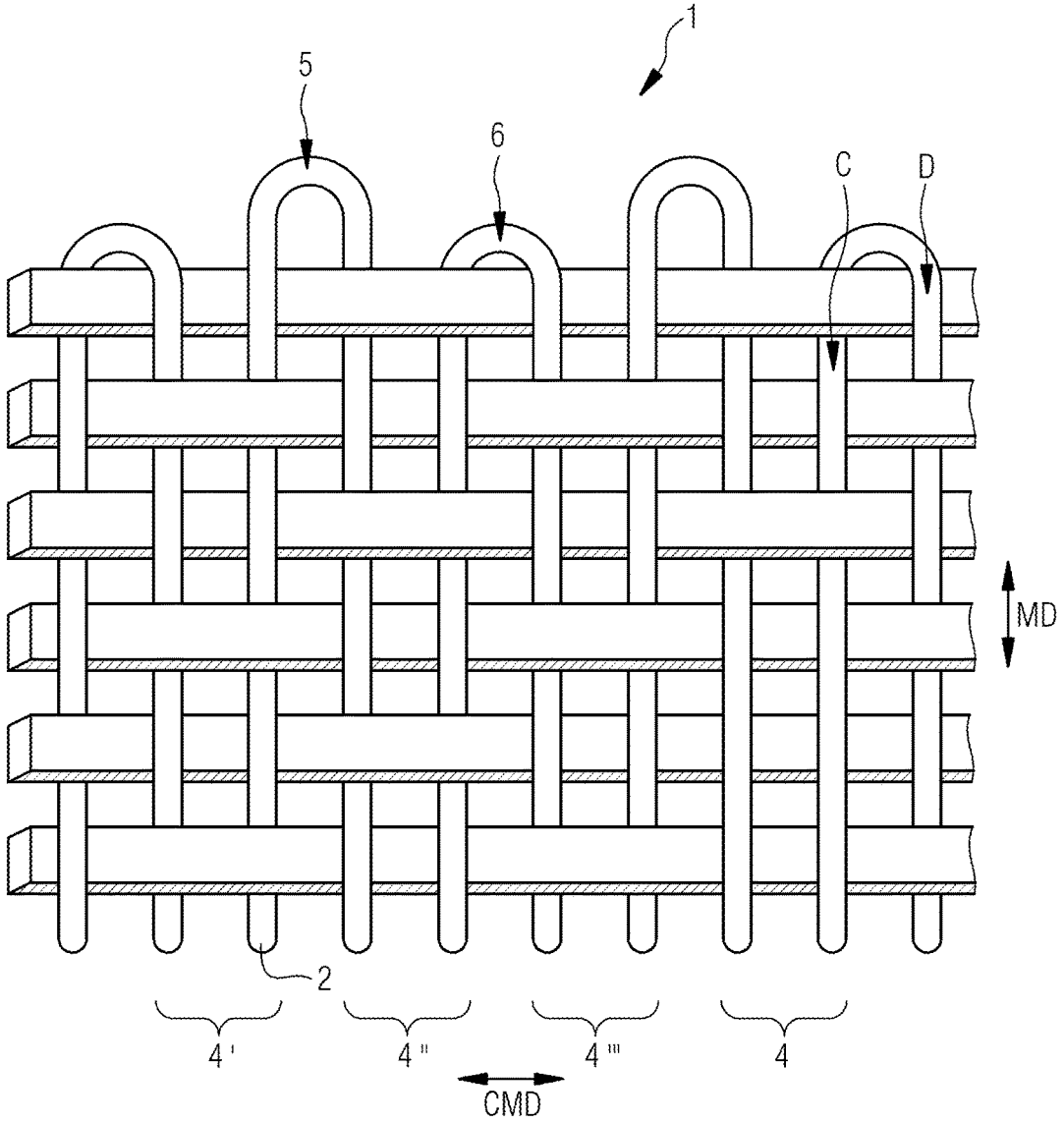
FIG. 6 shows top view onto a part of the dryer fabric as seen in FIG. 1 with a first variant of seam loop construction and FIG. 7 shows top view onto a part of the dryer fabric as seen in FIG. 1 with a second variant of seam loop construction.

FIG. 6 shows top view onto a part of the dryer fabric as seen in FIG. 1 with a first variant of seam loop construction. As can be seen part of the MD yarns 2 form seaming loops 5 which are arranged at the widthwise edges of the fabric 1 to make it endless. The other part of the MD yarns 2 form so called binder loops 6 to hold the widthwise fabric edges. As can be seen between adjacent seaming loops 5 a binder loop 6 is located and vice versa. In the embodiment as seen in FIG. 6 every seaming loop 5 and every binder loop 6 is formed by MD yarns 2 of different groups 4. By way of example one of the seaming loops 5 is formed by a MD yarn 2 of group 4' and by a MD yarn 2 of group 4" and adjacent binder loop 6 is formed by a MD yarn 2 of group 4" and by a MD yarn 2 of group 4'".

Figure 7:
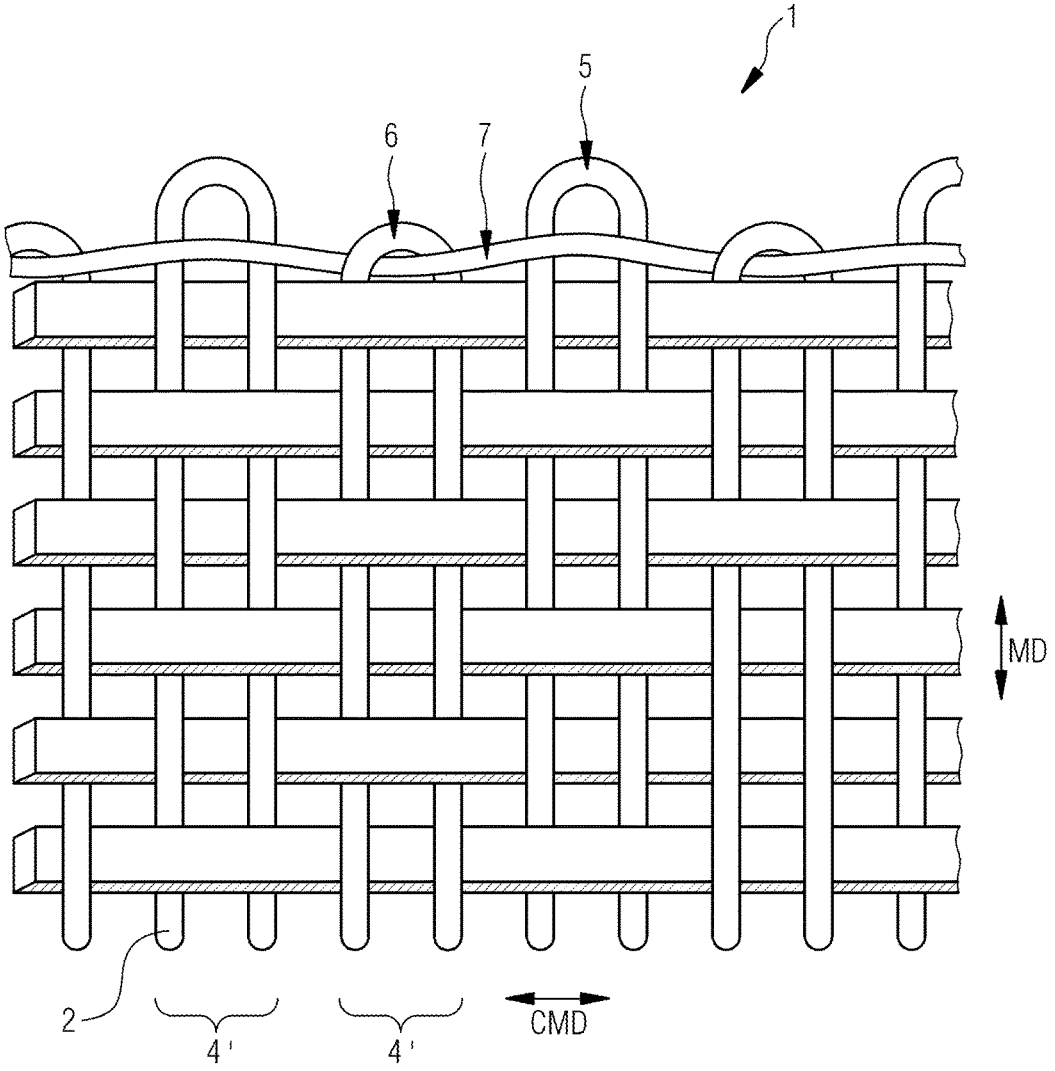

FIG. 7 shows top view onto a part of the dryer fabric as seen in FIG. 1 with a second variant of seam loop construction. As can be seen part of the MD yarns 2 form seaming loops 5 which are arranged at the widthwise edges of the fabric 1 to make it endless. The other part of the MD yarns 2 form so called binder loops 6 to hold the widthwise fabric edges. As can be seen between adjacent seaming loops 5 a binder loop 6 is located and vice versa. In the embodiment as seen in FIG. 7 every seaming loop 5 and every binder loop 6 is formed by MD yarns 2 of the same group 4. By way of example one of the seaming loops 5 is formed by the two MD yarns 2 of group 4' and adjacent binder loop 6 is formed by the two MD yarns 2 of another group 4". To hold the widthwise fabric edges this seam construction further has an additional end yarn 7 which passes through the binder loops 6 and over or under the seaming loops 5 without passing through them.

The invention claimed is:

1. A papermaking dryer fabric, comprising:

a system of MD yarns interwoven with a system of CMD yarns in a single layer weave;

said MD yarns including groups of MD yarns, with each of said groups of MD yarns being formed by a plurality of adjacent MD yarns weaving in said group side-by-side a same weave path with said CMD yarns, said MD yarns forming said groups of MD yarns having a circular cross section;

said CMD yarns being ungrouped CMD yarns and all of said CMD yarns having a non-circular cross section with a width to height ratio of more than 1, and said CMD yarns having a shape selected from the group consisting of a bone-shape and a double convex shape;

at least some CMD yarns being formed of a two-phase polymeric material, with a first polymeric material that melts at a first temperature and a second polymeric material which is substantially immiscible with the first polymeric material and which melts at a second temperature which is lower than the first temperature;

wherein the dryer fabric is flat woven with seaming loops arranged at widthwise edges of the fabric and formed in an endless dryer fabric, and wherein at least some of said seaming loops are formed by at least some MD yarns of said groups of MD yarns, and wherein the dryer fabric is formed to have an air permeability of between 25 cfm and 200 cfm.

2. The papermaking dryer fabric according to claim 1, wherein said single layer weave is a plain weave.

3. The papermaking dryer fabric according to claim 1, wherein all of said MD yarns form said groups of MD yarns.

4. The papermaking dryer fabric according to claim 1, wherein each said group of MD yarns is formed by four or fewer adjacent MD yarns weaving side-by-side the same weave path with said CMD yarns.

5. The papermaking dryer fabric according to claim 4, wherein each said group of MD yarns is formed by two or three MD yarns.

6. The papermaking dryer fabric according to claim 1, wherein said width to height ratio is 1.5 or more.

7. The papermaking dryer fabric according to claim 1, wherein said CMD yarns have a height of 0.5 mm or more.

8. The papermaking dryer fabric according to claim 7, wherein said CMD yarns have a height of between 0.5 mm and 1.1 mm.

9. The papermaking dryer fabric according to claim 7, wherein said CMD yarns have a height of between 0.6 mm and 1.0 mm.

10. The papermaking dryer fabric according to claim 7, wherein said CMD yarns have a height of between 0.7 mm and 0.9 mm.

11. The papermaking dryer fabric according to claim 1, wherein said MD yarns have a diameter between 0.5 mm and 0.8 mm.

12. The papermaking dryer fabric according to claim 11, wherein said MD yarns have a diameter between 0.55 mm and 0.65 mm.

13. The papermaking dryer fabric according to claim 1, wherein said air permeability of the fabric lies between 50 cfm and 200 cfm.

14. The papermaking dryer fabric according to claim 13, wherein said air permeability of the fabric lies between 50 cfm and 150 cfm.

15. The papermaking dryer fabric according to claim 1, wherein the fabric has the characteristics of having been subjected to a heat setting treatment at a temperature at or above the first temperature and below the second temperature.

16. The papermaking dryer fabric according to claim 1, wherein the fabric has two widthwise edges each provided with seaming loops formed by two MD yarns, wherein the fabric further has binder loops each being formed by two MD yarns, and wherein a binder loop is located between two adjacent seaming loops and vice versa.

17. The papermaking dryer fabric according to claim 16, wherein each of said seaming loops is formed by first and second MD yarns, and said first and second MD yarns are from the same group of MD yarns.

18. The papermaking dryer fabric according to claim 16, wherein each of said seaming loops is formed by a first MD yarn from a first group of MD yarns and by a second MD yarn from a second group of MD yarns adjacent to the first group of MD yarns.

19. The papermaking dryer fabric according to claim 1, wherein said second polymeric material is selected from the group consisting of polyolefins, polyamides, fluoropolymers and combinations thereof, and said first polymeric material includes, alone or in combination, homopolymers or copolymers of polyester.

* * * * *